US010634394B2

(12) United States Patent
Shimodahira et al.

(10) Patent No.: US 10,634,394 B2
(45) Date of Patent: Apr. 28, 2020

(54) AIR CONDITIONER OUTDOOR UNIT INCLUDING HEAT EXCHANGE APPARATUS

(71) Applicant: SAMSUNG ELECTRONICS CO., LTD., Suwon-si, Gyeonggi-do (KR)

(72) Inventors: Nobukazu Shimodahira, Yokohama (JP); Kimio Koda, Yokohama (JP); Hongzhi Sun, Yokohama (JP); Kazushige Tajima, Yokohama (JP); Takahiro Akizuki, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 426 days.

(21) Appl. No.: 15/258,640

(22) Filed: Sep. 7, 2016

(65) Prior Publication Data

US 2017/0176057 A1 Jun. 22, 2017

(30) Foreign Application Priority Data

Dec. 18, 2015 (JP) ..... 2015-247918
Dec. 21, 2015 (JP) ..... 2015-248764
Jun. 10, 2016 (KR) ..... 10-2016-0072519

(51) Int. Cl.
*F25B 5/00* (2006.01)
*F25B 13/00* (2006.01)
(Continued)

(52) U.S. Cl.
CPC ..... *F25B 13/00* (2013.01); *F25B 5/02* (2013.01); *F25B 6/02* (2013.01); *F25B 49/02* (2013.01);
(Continued)

(58) Field of Classification Search
None
See application file for complete search history.

(56) References Cited

U.S. PATENT DOCUMENTS

2002/0017110 A1* 2/2002 Chiu ..... F24F 1/42 62/305
2007/0261421 A1 11/2007 Pierson
(Continued)

FOREIGN PATENT DOCUMENTS

EP 2495510 9/2012
EP 2629031 8/2013
(Continued)

OTHER PUBLICATIONS

WCR Heat Exchanger Services (wcrhx.com/plate-heat-exchangers), "Plate Heat Exchangers", Nov. 28, 2015, p. 1-2.*
(Continued)

*Primary Examiner* — Jonathan Bradford
(74) *Attorney, Agent, or Firm* — Staas & Halsey LLP

(57) ABSTRACT

A heat exchange apparatus includes a first heat exchanger configured to transfer heat between a refrigerant and another medium, a plurality of second heat exchangers configured to transfer heat between the refrigerant and the liquid, a compressor configured to pressurize the refrigerant and a plurality of expansion devices for each of the plurality of second heat exchangers and configured to expand the refrigerant pressurized by the compressor, wherein the refrigerant flows through the plurality of second heat exchangers in parallel, and the liquid flows through the plurality of second heat exchangers in series.

10 Claims, 9 Drawing Sheets

(51) Int. Cl.
*F25B 5/02* (2006.01)
*F25B 6/02* (2006.01)
*F25B 49/02* (2006.01)

(52) U.S. Cl.
CPC . *F25B 2313/004* (2013.01); *F25B 2313/0253* (2013.01); *F25B 2313/0315* (2013.01); *F25B 2600/2513* (2013.01)

(56) References Cited

U.S. PATENT DOCUMENTS

| | | | | |
|---|---|---|---|---|
| 2010/0223939 | A1 | 9/2010 | Mitra et al. | |
| 2012/0042674 | A1* | 2/2012 | Takenaka | F24F 3/06 62/180 |
| 2012/0102991 | A1* | 5/2012 | Lee | F25B 7/00 62/160 |
| 2012/0222441 | A1 | 9/2012 | Sawada et al. | |
| 2012/0291460 | A1 | 11/2012 | Aoyagi | |
| 2014/0260358 | A1 | 9/2014 | Leete et al. | |
| 2014/0305150 | A1 | 10/2014 | Kim et al. | |
| 2015/0316275 | A1 | 11/2015 | Yamashita et al. | |

FOREIGN PATENT DOCUMENTS

| | | |
|---|---|---|
| JP | 2011-112303 | 6/2011 |
| WO | 2008/073108 A1 | 6/2008 |

OTHER PUBLICATIONS

International Search Report dated Dec. 29, 2016 in corresponding International Patent Application No. PCT/KR2016/010468.
Extended European Search Report dated Nov. 13, 2018 in European Patent Application No. 16875887.8.
Partial European Search Report dated Aug. 9, 2018 in European Patent Application No. 16875887.8.

* cited by examiner

AIR CONDITIONER OUTDOOR UNIT INCLUDING HEAT EXCHANGE APPARATUS

CROSS-REFERENCE TO RELATED APPLICATIONS

This application claims foreign priority benefit to Japanese Patent Application No. 2015-247918, filed on Dec. 18, 2015, Japanese Patent Application No. 2015-248764, filed on Dec. 21, 2015, and Korean Patent Application No. 10-2016-0072519, filed on Jun. 10, 2016 in the Korean Intellectual Property Office, the disclosures of which are incorporated herein by reference.

BACKGROUND

1. Field

Embodiments of the present disclosure relate to air conditioner outdoor units including a heat exchange apparatus.

2. Description of the Related Art

Heat exchange apparatuses to transfer heat between air and a liquid such as water using a refrigerant by connecting a compressor, an air heat exchanger, an expansion device, and a liquid heat exchanger have been widely used.

In general, a heat exchange apparatus includes a first heat exchanger to transfer heat between the refrigerant and air or a liquid and a second heat exchanger to transfer heat between the refrigerant and a liquid. Here, one first heat exchanger and one second heat exchanger are provided.

Plate type heat exchangers are generally used as the heat exchange apparatuses, and an amount of heat exchange is controlled by adjusting a stacking number of heat transfer plates in the plate type heat exchangers.

However, when the stacking number of heat transfer plates is increased to increase the amount of heat exchange of the heat exchange apparatus, a heat transfer rate of a refrigerant side may decrease due to non-uniform distribution of the refrigerant in a stacking direction of the heat transfer plates, and there is a limit to increase the stacking number of heat transfer plates.

Thus, there is a need to increase a heat transfer rate (heat transfer coefficient) of the refrigerant side and a heat transfer rate (heat transfer coefficient) of a liquid side such as water to improve heat transfer efficiency of the heat exchange apparatus without increasing the stacking number of heat transfer plates.

Also, the heat exchange apparatus is required to have a small volume, to be easily carried or installed (compact size), and to be efficiently maintained (maintainability).

SUMMARY

Therefore, it is an aspect of the present disclosure to provide a heat exchange apparatus having an increased heat transfer rate of a refrigerant side and an increased heat transfer rate of a liquid side such as water.

It is another aspect of the present disclosure to provide a heat exchange apparatus having a compact size and high maintainability.

Additional aspects of the disclosure will be set forth in part in the description which follows and, in part, will be obvious from the description, or may be learned by practice of the disclosure.

In accordance with one aspect of the present disclosure, an air conditioner outdoor unit comprising a heat exchange apparatus includes a first heat exchanger configured to transfer heat between a refrigerant and another medium (air or a liquid), a plurality of second heat exchangers configured to transfer heat between the refrigerant and the liquid, a compressor configured to pressurize the refrigerant and a plurality of expansion devices installed in each of the plurality of second heat exchangers and configured to expand the refrigerant pressurized by the compressor, wherein the refrigerant flows through the plurality of second heat exchangers in parallel, and the liquid flows through the plurality of second heat exchangers in series.

Each of the plurality of expansion devices may be connected to a refrigerant inlet/outlet of each of the plurality of second heat exchangers.

The liquid flowing through the plurality of second heat exchangers in series is water, and water may flow through the plurality of second heat exchangers via water pipes connected to the plurality of second heat exchangers.

Each of the plurality of second heat exchangers is a plate type heat exchanger, and the plurality of second heat exchangers may have the same or different stacking number of heat transfer plates.

Since the plurality of second heat exchangers are used, a stacking number of heat transfer plates of each of the plurality of second heat exchangers may be less than a stacking number of heat transfer plates of a second heat exchanger formed as a single device.

As the stacking number of the heat transfer plates decreases, the refrigerant is more uniformly distributed in a stacking direction of the heat transfer plates to may improve a heat transfer rate of the refrigerant.

The expansion devices are expansion valves, and the degrees of opening the expansion valves are controlled to may reduce a temperature difference between refrigerants respectively discharged from the plurality of second heat exchangers.

The heat exchange apparatus further may comprise a fluid flow bypass allowing water to bypass at least one of the plurality of second heat exchangers.

Water is transferred with high pressure by a pump connected to the water pipe, and power consumption may be reduced when water flows through the fluid flow bypass compared with when water flows through all of the plurality of second heat exchangers.

Further comprising two cases, wherein the heat exchange apparatus may be divided and accommodated in the two cases.

In accordance with another aspect of the present disclosure, an air conditioner outdoor unit comprising a heat exchange apparatus includes a first heat exchanger configured to transfer heat between a refrigerant and another medium (air or a liquid), a plurality of second heat exchangers configured to transfer heat between the refrigerant and the liquid, a compressor configured to pressurize the refrigerant and an expansion device installed to be shared by the plurality of second heat exchangers and configured to expand the refrigerant pressurized by the compressor, wherein the refrigerant flows through the plurality of second heat exchangers in parallel, and the liquid flows through the plurality of second heat exchangers in series, and the plurality of second heat exchangers have different heat transfer areas.

The liquid flowing through the plurality of second heat exchangers in series is water, and water may flow through the plurality of second heat exchangers via water pipes connected to the plurality of second heat exchangers.

Each of the plurality of second heat exchangers is a plate type heat exchanger, and stacking numbers of heat transfer plates of the plurality of second heat exchangers may be different.

A stacking number of heat transfer plates of each of the plurality of second heat exchangers may be set to reduce a difference in a heat transfer amount between the plurality of second heat exchangers.

In accordance with another aspect of the present disclosure, an air conditioner outdoor unit comprising a heat exchange apparatus includes a first case and a second case, two first heat exchangers configured to transfer heat between a refrigerant and another medium (air or a liquid), a compressor configured to pressurize the refrigerant, an accumulator configured to accumulate the refrigerant, a multi way valve configured to change a direction of the refrigerant, a refrigerant pipe configured to convey the refrigerant, a second heat exchanger configured to transfer heat between the refrigerant and the liquid and a liquid pipe configured to conveying the liquid, wherein the first case accommodates a liquid circuit through which the liquid flows comprising at least the second heat exchanger and the liquid pipe, the second case accommodates a refrigerant circuit through which the refrigerant flows comprising at least the compressor, the accumulator, the multi way valve, and the refrigerant pipe, and the first case and the second case comprise the two first heat exchanger, respectively.

The first case comprises a case panel opened and closed, and manipulation directions of a connection flange of the liquid pipe and a power control panel configured to control power of the second heat exchanger accommodated in the first case may be arranged close to the case panel.

The first case accommodates a plurality of second heat exchangers, each of the plurality of second heat exchangers is provided with an expansion device configured to expand the refrigerant pressurized by the compressor, and the refrigerant may flow through the plurality of second heat exchangers in parallel, and the liquid may flow through the plurality of second heat exchangers in series.

The liquid flowing through the plurality of second heat exchangers in series is water, and water may flow through the plurality of second heat exchangers via water pipes connected to the plurality of second heat exchangers.

The heat exchange apparatus further may comprise a fluid flow bypass allowing water to bypass at least one of the plurality of second heat exchangers.

The first case accommodates a plurality of second heat exchangers, an expansion device is installed to be shared by the plurality of second heat exchangers and expands the refrigerant pressurized by the compressor, the refrigerant flows through the plurality of second heat exchangers in parallel, and the liquid flows through the plurality of second heat exchangers in series, and the plurality of second heat exchangers may have different heat transfer areas.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
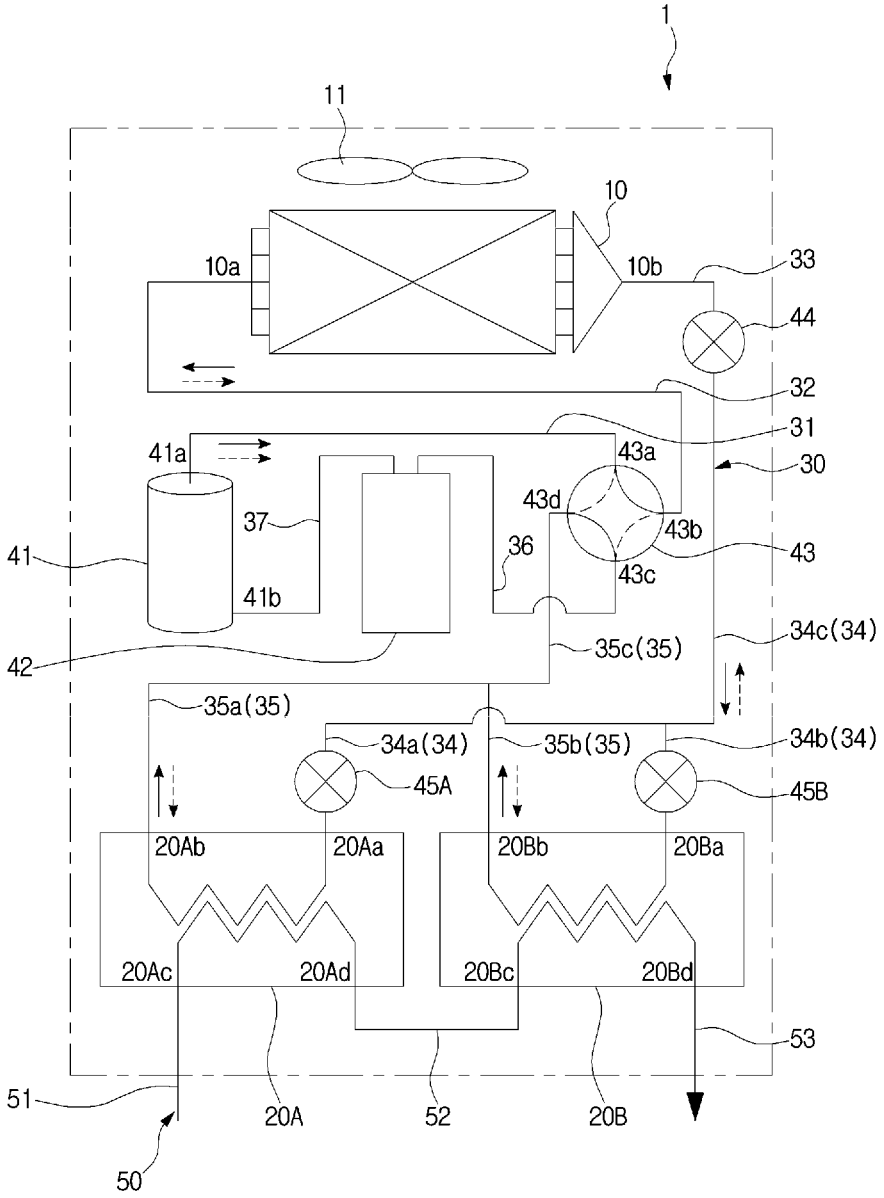
FIG. 1 is a view illustrating an example of a heat exchange apparatus according to a first embodiment.

Reference will now be made in detail to the embodiments of the present disclosure, examples of which are illustrated in the accompanying drawings, wherein like reference numerals refer to like elements throughout.

First Embodiment

Configuration of Heat Exchange Apparatus 1

An outdoor unit of an air conditioner includes a heat exchange apparatus. FIG. 1 is a view illustrating an example of a heat exchange apparatus 1 according to a first embodiment. The illustrated heat exchange apparatus 1 is also called a heat pump or a heat pump apparatus. For example, the heat exchange apparatus 1 is used to cool or heat a liquid such as water to a predetermined temperature. In addition, the heat exchange apparatus 1 is used in a freezer, a refrigerator, an air conditioner, or the like.

The heat exchange apparatus 1 includes an air cooled heat exchanger 10 to transfer heat between air and a refrigerant (hereinafter, referred to as air cooled heat exchanger 10) and a plurality of heat exchangers 20 to transfer heat between a liquid such as water and the refrigerant (hereinafter, referred to as water heat exchanger 20). In this case, the heat exchange apparatus 1 includes two water heat exchangers 20A and 20B. Although the water heat exchangers 20A and 20B are illustrated in FIG. 1, the embodiment is not limited thereto. When the water heat exchangers 20A and 20B are not distinguished, the water heat exchanger 20 is used.

The liquid may also be an anti-freezing solution such as glycerin instead of water. Hereinafter, however, water will be described as an example of the liquid.

However, in the air cooled heat exchanger 10, heat may be exchanged between a liquid such as water, instead of air, and the refrigerant. In this case, the air cooled heat exchanger 10 may be referred to as a water cooled heat exchanger. In the case of a water cooled heat exchanger, heat may be exchanged between water and the refrigerant.

Here, the air cooled heat exchanger 10 is an example of a first heat exchanger, and the water heat exchanger 20 is an example of a second heat exchanger.

The heat exchange apparatus 1 includes a refrigerant pipe 30 to circulate the refrigerant between the air cooled heat exchanger 10 and the water heat exchangers 20A and 20B.

Examples of the refrigerant may include chlorofluorocarbon (Freon) having a low-boiling point. However, the refrigerant may be any other material instead of chlorofluorocarbon.

The heat exchange apparatus 1 includes a fan 11 to blow air toward the air cooled heat exchanger 10. The heat exchange apparatus 1 includes a compressor 41 connected to the refrigerant pipe 30 that circulates the refrigerant, and an accumulator 42. The heat exchange apparatus 1 includes a 4-way valve (4-way switching valve) 43, and an expansion valve 44. The heat exchange apparatus 1 includes an expansion valve 45 per each of the plurality of water heat exchangers 20. In this regard, the plurality of water heat exchangers 20 are described using the water heat exchangers 20A and 20B, and the expansion valve 45 is described using two expansion valves 45A and 45B. When the expansion valves 45A and 45B are not distinguished, the expansion valve 45 is used.

Here, the expansion valve 45 (expansion valves 45A and 45B) is an example of an expansion device.

The air cooled heat exchanger 10 exchanges heat with air by circulating the refrigerant therein. The air cooled heat exchanger 10 includes a cooling tube through which the refrigerant flows. A cross fin type cooling tube provided with a fin outside the cooling tube is used. The cooling tubes are arranged in a plurality of rows in a zigzag shape to increase heat exchange efficiency of the air cooled heat exchanger 10.

The air cooled heat exchanger 10 may operate as a condenser when the heat exchange apparatus 1 cools water and as an evaporator when the heat exchange apparatus 1 heats water.

The fan 11 may be a propeller fan. The fan 11 includes a propeller (wings) mounted about a rotary shaft. As the propeller rotates, air is blown with high pressure by the propeller and an air flow is generated in a direction of the rotary shaft. Heat exchange of the air cooled heat exchanger 10 is accelerated by blowing the air flow toward the air cooled heat exchanger 10.

The water heat exchanger 20 transfers heat between the refrigerant and water by arranging a refrigerant path and a water path adjacent to each other. The water heat exchanger 20 may be a plate (flat panel) type heat exchanger. The plate type heat exchanger uses a thin plate formed of stainless steel or titanium as a heat transfer plate. A desired number of heat transfer plates are stacked and fixed by brazing.

A high-temperature fluid and a low-temperature fluid are disposed at both sides of one heat transfer plate to be adjacent to each other such that the high-temperature fluid and the low-temperature fluid respectively flow through paths formed in gaps between the heat transfer plates. That is, the plate type heat exchanger involves heat transfer between the high-temperature fluid and the low-temperature fluid through the heat transfer plates. Thus, a heat transfer amount (heat exchange amount) between the high-temperature fluid and the low-temperature fluid is determined by the number (stacked number) of heat transfer plates in the plate type heat exchanger.

Here, the heat transfer amount (heat exchange amount) refers to an amount of thermal energy transferred (exchanged) per unit hour. The heat transfer amount is determined according to heat transfer area, amount of cooled or heated liquid, specific heat of cooled or heated liquid, temperature change of cooled or heated liquid, overall heat transfer coefficient, log mean temperature difference, or the like. However, the heat transfer area refers to an area where heat exchange between the high-temperature fluid and the low-temperature fluid takes place and corresponds to the number of the heat transfer plates.

In addition, the overall heat transfer coefficient indicates performance of the water heat exchanger 20. The overall heat transfer coefficient is determined by high-temperature fluid side film heat transfer coefficient, low-temperature fluid side film heat transfer coefficient, thickness of heat transfer wall (heat transfer plate), thermal conductivity of the heat transfer wall (heat transfer plate), and the like. In this regard, the high-temperature fluid side film heat transfer coefficient and the low-temperature fluid side film heat transfer coefficient refer to efficiency of heat transfer (thermal efficiency) when a boundary layer (film) is assumed to be formed near the heat transfer wall (heat transfer plate). The boundary layer (film) serves as a heat transfer resistance against heat transfer. The heat transfer resistance decreases in a rough flow, i.e., as a velocity of the fluid increases, thereby increasing heat transfer efficiency. That is, the high-temperature fluid side film heat transfer coefficient increases as the thickness of the high-temperature fluid side film decreases. The low-temperature fluid side film heat transfer coefficient increases as the thickness of the low-temperature fluid side film decreases. That is, both the high-temperature fluid side film heat transfer coefficient and the low-temperature fluid side film heat transfer coefficient increase as the flow rate increases.

Here, the high-temperature fluid side film heat transfer coefficient and the low-temperature fluid side film heat transfer coefficient will be referred to as a refrigerant side heat transfer rate (heat transfer coefficient) and a liquid side heat transfer rate (heat transfer coefficient).

Here, the water heat exchangers 20A and 20B are described as plate type heat exchangers having the same configuration. That is, the water heat exchangers 20A and 20B may have the same heat transfer area by including the same number of heat transfer plates.

Figure 2:
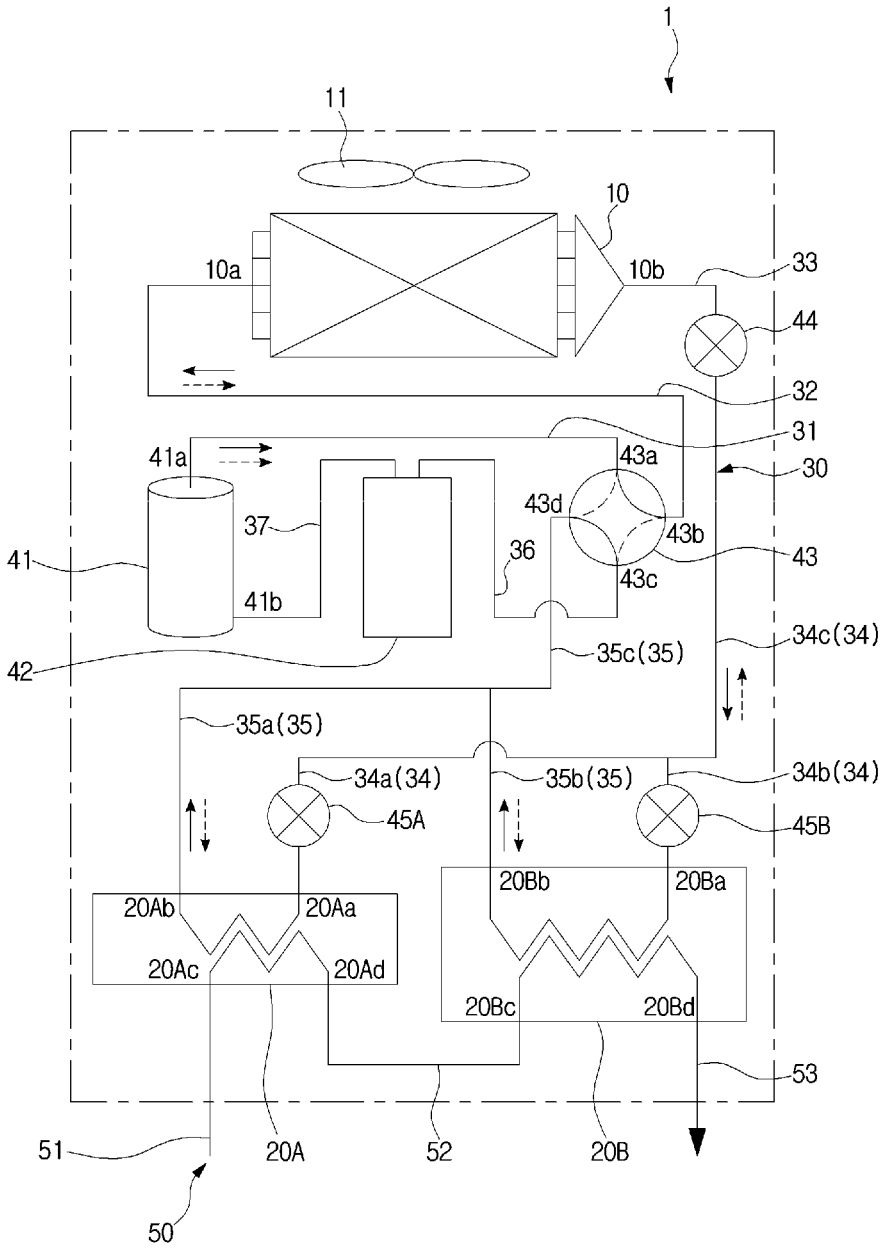
FIG. 2 is a view illustrating a water heat exchangers may include different numbers of heat transfer plates in a heat exchange apparatus according to a first embodiment.

However, the embodiment is not limited thereto, and the water heat exchangers 20A and 20B may include different numbers of heat transfer plates as illustrated in FIG. 2.

The water heat exchanger 20 operates as an evaporator when the heat exchange apparatus 1 cools water and as a condenser when the heat exchange apparatus 1 heats water.

In the water heat exchanger 20A, the refrigerant flows between a refrigerant inlet/outlet 20Aa and a refrigerant inlet/outlet 20Ab. In the water heat exchanger 20B, the refrigerant flows between a refrigerant inlet/outlet 20Ba and a refrigerant inlet/outlet 20Bb. However, a flow direction of the refrigerant when the heat exchange apparatus 1 cools water is reversed from that when the heat exchange apparatus 1 heats water. Thus, the term "inlet/outlet" used therefor.

In the water heat exchanger 20A, water flows from a water inlet 20Ac to a water outlet 20Ad. In the water heat exchanger 20B, water flows from a water inlet 20Bc to a water outlet 20Bd. A water flow direction when the heat exchange apparatus 1 cools water is the same as that when the heat exchange apparatus 1 heats water. Thus, the terms "inlet" and "outlet" are used therefor.

In addition, water exchanges heat with the refrigerant while flowing adjacent to the refrigerant in the water heat exchangers 20A and 20B in which the heat transfer plate is disposed between water and the refrigerant.

In this case, since the flow direction of the refrigerant when the heat exchange apparatus 1 cools water is opposite to that when the heat exchange apparatus 1 heats water, ports through which the refrigerant passes are referred to as inlets/outlets.

The compressor 41 pressurizes and discharges the refrigerant and circulates the refrigerant between the air cooled heat exchanger 10 and the water heat exchangers 20A and 20B. The compressor 41 may be a scroll type compressor. The scroll type compressor includes a fixed scroll and an eccentrically orbiting scroll including two wings. In this case, the refrigerant absorbed from the outer circumference is gradually compressed while proceeding to the center. However, the compressor 41 is not limited thereto and may also be a rotary type compressor configured to pressurize the refrigerant by rotating a biased piston.

For example, the compressor 41 is controlled by an inverter. Revolutions per minute (RPM) of the compressor 41 are controlled by the inverter and an amount of refrigerant discharged varies by the inverter.

The accumulator 42 separates a refrigerant solution that has not been evaporated and accumulates the refrigerant solution.

The 4-way valve 43 changes a refrigerant path (direction of passing) depending on when water is cooled by the refrigerant and when water is heated by using the refrigerant.

Although detailed description will be given later, the heat exchange apparatus 1 cools water when the 4-way valve 43 is set at a solid line position. That is, in this case, water is the high-temperature fluid and the refrigerant is the low-temperature fluid, and a temperature of water is higher than that of the refrigerant.

Meanwhile, when the 4-way valve 43 is set at a dashed line position, the heat exchange apparatus 1 heats water. That is, in this case, water is the low-temperature fluid and the refrigerant is the high-temperature fluid, and a temperature of water is lower than that of the refrigerant.

The 4-way valve 43 is shifted between the solid line position and the dashed line position.

For example, the expansion valves 44, 45A, and 45B may be electronic expansion valves. In this case, the degrees of opening the valves may be adjusted by driving a pulse motor.

Connection relations of the refrigerant pipe 30 through which the refrigerant passes will be described. Hereinafter, the refrigerant pipe 30 may be described as refrigerant pipes 31 and 32 depending on positions thereof. However, the 4-way valve 43 at the solid line position of FIG. 1 indicates a case in which the heat exchange apparatus 1 cools water. Connection relations of the refrigerant pipe 30 in this case will be described.

The outlet 41*a* of the compressor 41 is connected to an inlet/outlet 43*a* of the 4-way valve 43 via the refrigerant pipe 31. An inlet/outlet 43*b* of the 4-way valve 43 is connected to an inlet/outlet 10*a* of the air cooled heat exchanger 10 via the refrigerant pipe 32. An inlet/outlet 10*b* of the air cooled heat exchanger 10 is connected to the expansion valve 44. The expansion valve 44 is connected to a refrigerant pipe 34*c*. The refrigerant pipe 34*c* is divided into a refrigerant pipe 34*a* and a refrigerant pipe 34*b*. The refrigerant pipe 34*a* is connected to the expansion valve 45A, and the refrigerant pipe 34*b* is connected to the expansion valve 45B.

In this regard, when the refrigerant pipes 34*a*, 34*b*, and 34*c* are not distinguished from one another, the refrigerant pipe 34 is used (In FIG. 1, a refrigerant pipe 34*a*(34) is used).

The expansion valve 45A is connected to the refrigerant inlet/outlet 20Aa of the water heat exchanger 20A. Meanwhile, the expansion valve 45B is connected to the refrigerant inlet/outlet 20Ba of the water heat exchanger 20B. The refrigerant inlet/outlet 20Ab of the water heat exchanger 20A is connected to a refrigerant pipe 35*a*. Similarly, the refrigerant inlet/outlet 20Bb of the water heat exchanger 20B is connected to a refrigerant pipe 35*b*. The refrigerant pipes 35*a* and 35*b* join a refrigerant pipe 35*c*.

In this regard, when the refrigerant pipes 35*a*, 35*b*, and 35*c* are not distinguished from one another, the refrigerant pipe 35 is used (In FIG. 1, a refrigerant pipe 35*a*(35) is used).

The refrigerant pipe 35*c* is connected to an inlet/outlet 43*d* of the 4-way valve 43. In addition, an inlet/outlet 43*c* of the 4-way valve 43 is connected to an inlet of the accumulator 42 via a refrigerant pipe 36. An outlet of the accumulator 42 is connected to an inlet 41*b* of the compressor 41 via a refrigerant pipe 37.

Here, the refrigerant inlet/outlet 20Ab of the water heat exchanger 20A may be connected to the expansion valve 45A, and the refrigerant inlet/outlet 20Aa may be connected to the refrigerant pipe 35*a*. The refrigerant inlet/outlet 20Bb of the water heat exchanger 20B may be connected to the expansion valve 45B, and the refrigerant inlet/outlet 20Ba may be connected to the refrigerant pipe 35*b*. In addition, connections of any one of the water heat exchanger 20A and the water heat exchanger 20B may be changed.

Then, connection relations of a water pipe 50 through which water flows will be described. The water heat exchangers 20A and 20B are connected to the water pipe 50 through which water flows. Here, a pipe through which water flows as a whole is denoted as the water pipe 50. The pipe is denoted as water pipes 51 and 52.

First, a water pipe 51 is connected to the water inlet 20Ac of the water heat exchanger 20A. The water outlet 20Ad of the water heat exchanger 20A is connected one end of the water pipe 52.

Then, the other end of the water pipe 52 is connected to the water inlet 20Bc of the water heat exchanger 20B. The water outlet 20Bd of the water heat exchanger 20B is connected to a water pipe 53.

Operation of Heat Exchange Apparatus 1

Operation of the heat exchange apparatus 1 when the heat exchange apparatus 1 cools water, i.e., when the temperature of water is higher than that of the refrigerant, will be described. In this case, water is the high-temperature fluid and the refrigerant is the low-temperature fluid in the water heat exchangers 20A and 20B. Here, the 4-way valve 43 is set such that the refrigerant passes through a solid line path illustrated in FIG. 1. The refrigerant flows in a direction marked as a solid line arrow of FIG. 1.

That is, when the heat exchange apparatus 1 cools water, the refrigerant flows in the order of the compressor 41, the 4-way valve 43, the air cooled heat exchanger 10, and the expansion valve 44. Then, the refrigerant flows in the order of the refrigerant pipe 34*a*, the expansion valve 45A, and the water heat exchanger 20A from the refrigerant pipe 34*c* connected to the expansion valve 44. Then, the refrigerant flows from the refrigerant pipe 35*a* and returns to the compressor 41 through the refrigerant pipe 35*c*, the 4-way valve 43, and the accumulator 42.

Also, the refrigerant flows from the refrigerant pipe 34*c* connected to the expansion valve 44 through the refrigerant pipe 34*b*, the expansion valve 45B, and the water heat exchanger 20B. The refrigerant flows from the refrigerant pipe 35*b* and returns to the compressor 41 via the refrigerant pipe 35*c*, the 4-way valve 43, and the accumulator 42.

That is, the refrigerant flows through the water heat exchanger 20A and the water heat exchanger 20B in parallel.

Meanwhile, water is supplied from the water pipe 51, flows through the water heat exchanger 20A, the water pipe 52, and the water heat exchanger 20B, and is discharged toward the water pipe 53. That is, water flows through the water heat exchanger 20A and the water heat exchanger 20B in series.

In the water flow, the water heat exchanger 20A is an upstream side, and the water heat exchanger 20B is a downstream side.

In more particular, the refrigerant in a high-temperature high-pressure gas state that is compressed in the compressor 41 and discharged from the outlet 41*a* thereof is transferred to the inlet/outlet 10*a* of the air cooled heat exchanger 10 via the 4-way valve 43. As described above, when the heat exchange apparatus 1 cools water, the air cooled heat exchanger 10 operates as a condenser. Thus, the refrigerant exchanges heat with air, and is condensed into a supercooled liquid in the air cooled heat exchanger 10, and is discharged from the inlet/outlet 10*b* of the air cooled heat exchanger 10. The high-pressure liquid-phase refrigerant discharged from the air cooled heat exchanger 10 is depressurized in the expansion valve 44 into a gas-liquid two phase state. The gas-liquid two phase refrigerant flowing from the refrigerant pipe 34*c* and the refrigerant pipe 34*a* is further depressurized in the expansion valve 45A and is transferred to the water heat exchanger 20A. Also, the gas-liquid two phase refrigerant flowing from the refrigerant pipe 34*c* and the refrigerant pipe 34*b* is further depressurized in the expansion valve 45B and is transferred to the water heat exchanger 20B. In this case, the water heat exchangers 20A and 20B operate as evaporators. Thus, the refrigerant exchanges heat with water and evaporated in the water heat exchangers 20A and 20B to a low-pressure gas phase. The refrigerant discharged from the refrigerant inlet/outlet 20Ab of the water heat exchanger 20A is transferred to the 4-way valve 43 via the refrigerant pipe 35*a* and the refrigerant pipe 35*c*. The refrigerant discharged from the refrigerant inlet/outlet 20Bb of the water heat exchanger 20B is transferred to the 4-way valve 43 via the refrigerant pipe 35*b* and the refrigerant pipe 35*c*. The refrigerant in a low-pressure gas state passing through the 4-way valve 43 flows through the accumulator 42, is sucked by the compressor 41, and is compressed in the compressor 41 again. This operation is repeated.

In this case, water is cooled by latent heat generated when the refrigerant is evaporated in the water heat exchangers 20A and 20B.

Next, operation of the heat exchange apparatus 1 when the heat exchange apparatus 1 heats water using the refrigerant, i.e., when the temperature of water is lower than that of the refrigerant, will be described. In this case, water is the low-temperature fluid and the refrigerant is the high-temperature fluid in the water heat exchangers 20A and 20B. Here, the 4-way valve 43 is set such that the refrigerant passes through a dashed line path illustrated in FIG. 1. The refrigerant flows in a direction marked as a dashed line arrow of FIG. 1.

That is, when the heat exchange apparatus 1 heats water, the refrigerant flows in the order of the compressor 41, the accumulator 42, and the 4-way valve 43. Then, the refrigerant flows in the order of the refrigerant pipe 35*c*, the refrigerant pipe 35*a*, the water heat exchanger 20A, the expansion valve 45A, and the refrigerant pipe 34*a*. Also, the refrigerant flows in the order of the refrigerant pipe 35*c*, the refrigerant pipe 35*b*, the water heat exchanger 20B, the expansion valve 45B, and the refrigerant pipe 34*b*. Then, the refrigerants join the refrigerant pipe 34*c*, flow in the order of the expansion valve 44, the air cooled heat exchanger 10, the 4-way valve 43, and the accumulator 42, and returns to the compressor 41. This operation is repeated.

That is, the refrigerant flows through the water heat exchanger 20A and the water heat exchanger 20B in parallel as well when the heat exchange apparatus 1 heats water.

Meanwhile, water is supplied from the water pipe 51, flows through the water heat exchanger 20A, the water pipe 52, and the water heat exchanger 20B, and is discharged toward the water pipe 53. That is, water flows through the water heat exchanger 20A and the water heat exchanger 20B in series.

In the water flow, the water heat exchanger 20A is an upstream side, and the water heat exchanger 20B is a downstream side.

In more particular, the refrigerant in a high-temperature high-pressure gas state that is compressed in the compressor 41 and discharged from the outlet 41*a* thereof is transferred to the water heat exchangers 20A and 20B in parallel via the 4-way valve 43. As described above, when the heat exchange apparatus 1 heats water, the water heat exchangers 20A and 20B operate as condensers. Thus, the refrigerant exchanges heat with water, and is condensed into a supercooled liquid in the water heat exchangers 20A and 20B. The refrigerant is discharged from the refrigerant inlet/outlet 20Aa of the water heat exchanger 20A to the expansion valve 45A. Similarly, the refrigerant is discharged to the expansion valve 45B from the refrigerant inlet/outlet 20Ba of the water heat exchanger 20B.

The high-pressure liquid-phase refrigerant discharged from the water heat exchangers 20A and 20B are depressurized in the expansion valves 45A and 45B into a gas-liquid two phase state. The refrigerant passing through the expansion valve 45A is transferred from the refrigerant pipe 34*a* to the refrigerant pipe 34*c*. Similarly, the refrigerant passing through the expansion valve 45B is transferred from the refrigerant pipe 34*b* to the refrigerant pipe 34*c*. That is, the refrigerant passing through the refrigerant pipe 34*a* and the refrigerant passing through the refrigerant pipe 34*b* join the refrigerant pipe 34*c*. Then, the refrigerant is further depressurized in the expansion valve 44 and transferred to the inlet/outlet 10*b* of the air cooled heat exchanger 10. In this case, the air cooled heat exchanger 10 operates as an evaporator. Thus, the refrigerant exchanges heat with air in the air cooled heat exchanger 10 and is evaporated. The refrigerant in a low-pressure gas state discharged from the inlet/outlet 10*a* of the air cooled heat exchanger 10 is sucked by the inlet 41*b* of the compressor 41 via the accumulator 42 and compressed in the compressor 41 again. This operation is repeated.

In this case, water is heated by the refrigerant in a high-temperature high-pressure gas state in the water heat exchangers 20A and 20B.

Figure 3:
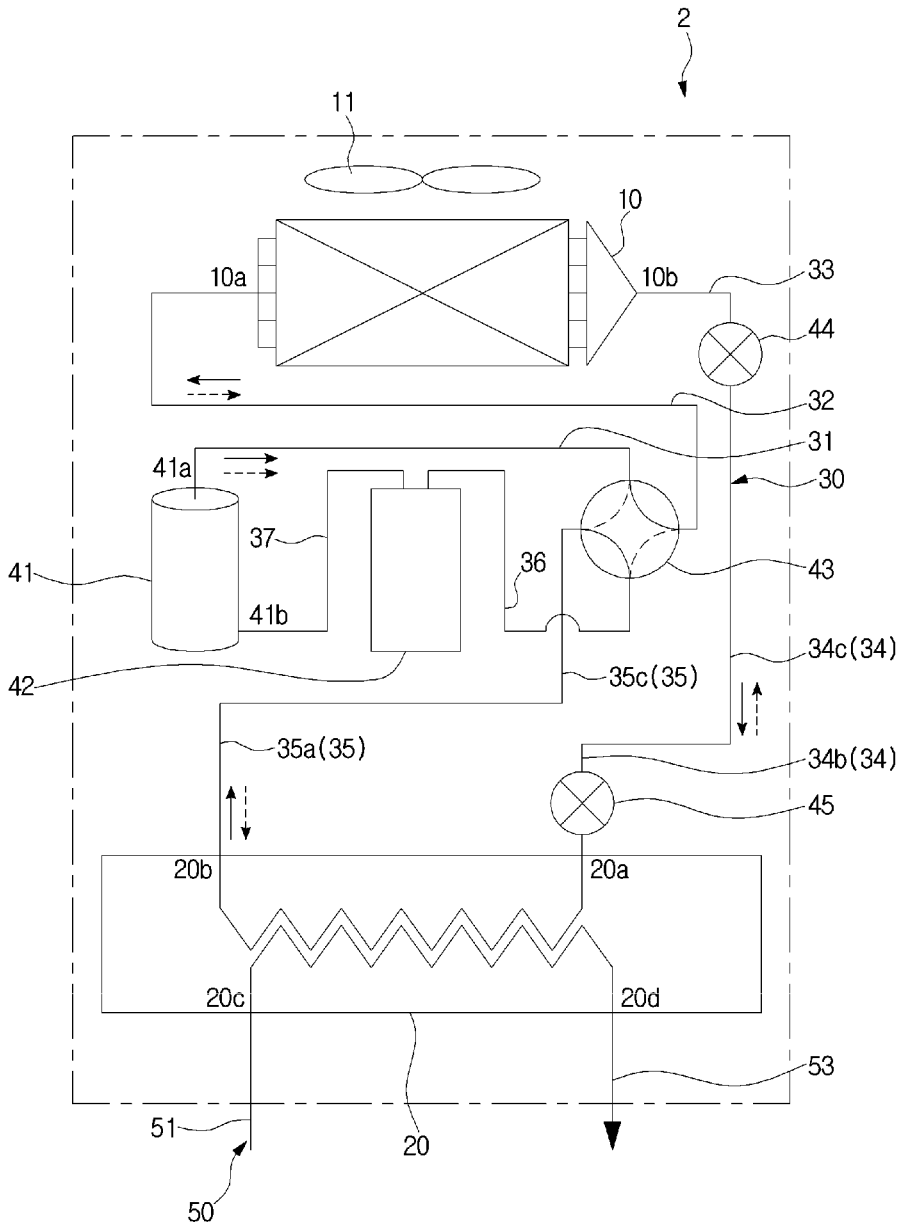
FIG. 3 is a view illustrating a heat exchange apparatus to which the first embodiment is not applied.

FIG. 3 is a view illustrating a heat exchange apparatus 2 to which the first embodiment is not applied.

The heat exchange apparatus 1 according to the first embodiment includes a plurality of water heat exchangers 20. Here, the refrigerant flows through the plurality of water heat exchangers 20 in parallel, and water flows through the plurality of water heat exchangers 20 in series.

The heat exchange apparatus 2 illustrated in FIG. 3, to which the first embodiment is not applied, includes one water heat exchanger 20 and one expansion valve 45. Thus, reference numerals A and B were not used in the water heat exchanger 20 and the expansion valve 45. Since the other elements are the same as those of the heat exchange apparatus 1 according to the first embodiment illustrated in FIG. 1, the same reference numerals are used herein and descriptions presented above will not be repeated.

If the water heat exchanger 20 is a plate type heat exchanger, a heat transfer area (number of the heat transfer plates) corresponding to a heat transfer amount is required in order to obtain a predetermined heat transfer amount. That is, a total heat transfer area of the plurality of water heat exchangers 20 is the same as or similar to that of a single water heat exchanger 20 that is not divided.

However, in the heat exchange apparatus 1 according to the first embodiment illustrated in FIG. 1, the heat transfer area corresponding the heat transfer amount is divided into the water heat exchangers 20A and 20B. Thus, the number of the stacked heat transfer plate of each of the water heat exchangers 20A and 20B is reduced, the refrigerant is uniformly distributed in a stacking direction of the heat transfer plates. Thus, the refrigerant side heat transfer rate (heat transfer coefficient) is increased (improved).

In addition, water may flow through the water heat exchangers 20A and 20B in parallel in the heat exchange apparatus 1. However, when an amount of discharged water per unit hour is predetermined in the heat exchange apparatus 1, a flow rate of water flowing in series is greater than those of water flowing in parallel. That is, water is transferred with high pressure. Thus, the liquid side heat transfer rate (heat transfer coefficient) is increased (improved).

As described above, in the heat exchange apparatus 1 according to the first embodiment, the refrigerant flows through the plurality of water heat exchangers 20 in parallel, and water flows therethrough in series. Thus, the heat exchange apparatus 1 according to the first embodiment has a higher overall heat transfer coefficient than the heat exchange apparatus 2. Thus, heat exchange efficiency of the heat exchange apparatus 1 is increased thereby.

Here, water passes through the downstream water heat exchanger 20B after passing through the upstream water heat exchanger 20A. Thus, the heat transfer amount of the upstream water heat exchanger 20A is different from the heat transfer amount of the downstream water heat exchanger 20B. In this case, the upstream water heat exchanger 20A and the downstream water heat exchanger 20B are respectively provided with the expansion valves 45A and 45B to control a temperature of the refrigerant discharged from the refrigerant inlet/outlet 20Ab of the water heat exchanger 20A to be the same as or similar to that of the refrigerant discharged from the refrigerant inlet/outlet 20Bb of the water heat exchanger 20B.

That is, since the heat transfer amount of the upstream water heat exchanger 20A is greater than that of the downstream water heat exchanger 20B, the expansion valve 45A is opened wider to flow a more amount of the refrigerant. Meanwhile, since the heat transfer amount of the downstream water heat exchanger 20B is smaller than that of the upstream water heat exchanger 20A, the expansion valve 45B is opened narrower to flow a less amount of the refrigerant. As a result, the temperature of the refrigerant discharged from the upstream water heat exchanger 20A becomes the same as or similar to that of the refrigerant discharged from the downstream water heat exchanger 20B.

Here, the water heat exchanger 20A and the water heat exchanger 20B are respectively provided with the expansion valves 45A and 45B. The degrees of opening the expansion valves 45A and 45B may be controlled to reduce a difference between the heat transfer amount of the upstream water heat exchanger 20A and the heat transfer amount of the downstream water heat exchanger 20B. Thus, the heat transfer amounts of the water heat exchanger 20A and the water heat exchanger 20B may be set within a range to reduce a temperature difference between the refrigerant discharged from the upstream water heat exchanger 20A and the refrigerant discharged from the downstream water heat exchanger 20B.

Here, the heat transfer amounts of the water heat exchanger 20A and the water heat exchanger 20B may be set within a range to reduce the temperature of the refrigerant discharged from the upstream water heat exchanger 20A and the temperature of the refrigerant discharged from the downstream water heat exchanger 20B.

That is, the degrees of opening the expansion valves 45A and 45B may be adjusted while a program control using a control circuit (not shown) including a CPU by sensing temperature of the refrigerants discharged from the water heat exchangers 20A and 20B.

Second Embodiment

In the heat exchange apparatus 1 according to the first embodiment illustrated in FIG. 1, water passes through the water heat exchangers 20A and 20B of the water heat exchanger 20 in series.

In a heat exchange apparatus 1 according to a second embodiment, water may bypass the upstream water heat exchanger 20A.

Figure 4:
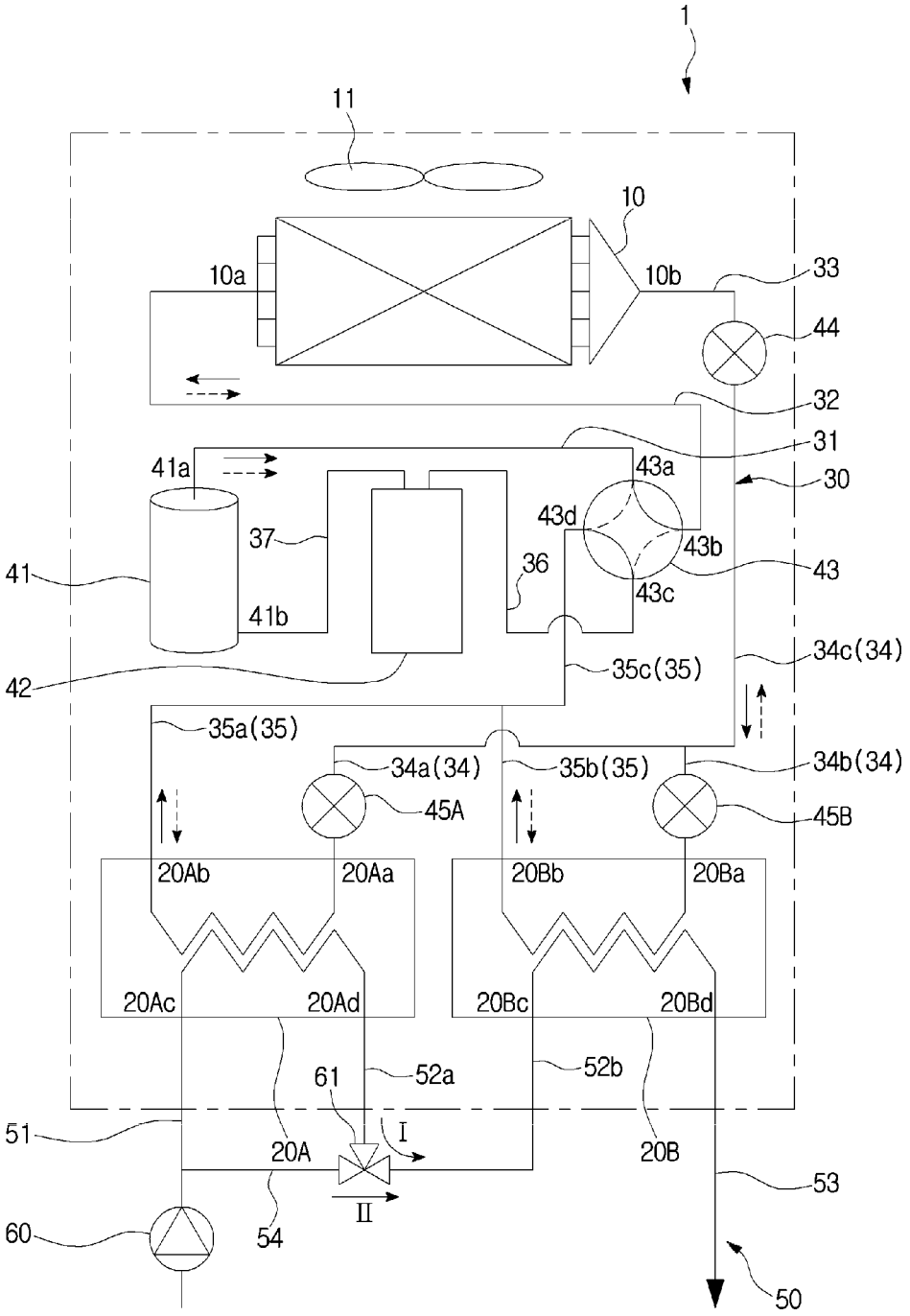
FIG. 4 is a view illustrating an examples of the heat exchange apparatus according to the second embodiment.

FIG. 4 is a view illustrating an examples of the heat exchange apparatus 1 according to the second embodiment.

Hereinafter, the heat exchange apparatus 1 according to the second embodiment will be described based on differences from the heat exchange apparatus 1 according to the first embodiment, the same reference numerals are used herein, and descriptions presented above will not be repeated.

As illustrated in FIG. 4, in the heat exchange apparatus 1 according to the second embodiment, the water pipe 52 of the heat exchange apparatus 1 according to the first embodiment illustrated in FIG. 1 disposed between the water outlet 20Ad of the water heat exchanger 20A and the water inlet 20Bc of the water heat exchanger 20B is divided into a water pipe 52*a* and a water pipe 52*b*. A 3-way valve 61 is installed at the divided portion. In addition, a water pipe 54, which branches off from the water pipe 51 connected to the water inlet 20Ac of the water heat exchanger 20A, is connected to the 3-way valve 61.

That is, when the 3-way valve 61 is set to form the fluid flow path at a position marked by arrow I, water flows through the upstream water heat exchanger 20A and the downstream water heat exchanger 20B in series in the same manner as in the heat exchange apparatus 1 according to the first embodiment. Meanwhile, when the 3-way valve 61 is set to form the fluid flow path at a position marked by arrow II, water bypasses the upstream water heat exchanger 20A and flows only through the downstream water heat exchanger 20B.

In this case, the fluid flow path marked by arrow II through which water flows through the water pipe 54 and the 3-way valve 61 is an example of a fluid flow bypass.

Water is transferred with high pressure by a pump 60 connected to the water pipe 51. The pump 60 may be a pump driven by an inverter type motor. The pump driven by the inverter type motor may operate in accordance with an amount of water.

Next, operation of the heat exchange apparatus 1 according to the second embodiment will be described.

A case in which water is cooled will be described. In this case, there is little temperature difference between supplied water and discharged water or there is no need to drive the heat exchange apparatus 1 in full (hereinafter, referred to as a partial load case). In this partial load case, the 3-way valve 61 is manipulated to make water flow through the fluid flow path II. Thus, water bypasses the water heat exchanger 20A and flows through the water heat exchanger 20B.

Then, the degree of opening the expansion valve 45A is set to "0" (the expansion valve 45A is closed) to stop the refrigerant from flowing through the water heat exchanger 20A and to stop heat exchange by the water heat exchanger 20A.

In addition, since water bypasses the water heat exchanger 20A and flows only through the water heat exchanger 20B, an amount of the water flow may increase unless a power of discharging water by the pump 60 is controlled. In this case, the amount of the water flow of the water heat exchanger 20A may be adjusted to be the same as that of the water heat exchanger 20B by controlling the RPM of the pump 60 using a motor, e.g., the inverter type motor.

As a result, power consumption of the pump 60 may be reduced by reducing power of the pump 60 as described above.

The 3-way valve 61, the expansion valve 45A, and the pump 60 may be controlled by a program using a control circuit (not shown) including a CPU, and the like.

Although the 3-way valve 61 switches over between the fluid flow path I and the fluid flow path II according to the present embodiment, the amounts of water flowing through the fluid flow path I and the fluid flow path II may be controlled. That is, the amount of water flowing through the fluid flow path I, i.e., flowing through the water heat exchanger 20A, may be adjusted by the amount of water flowing through the fluid flow path II.

Although water bypasses the upstream water heat exchanger 20A herein, water may also bypass the downstream water heat exchanger 20B.

In addition, the number of the water heat exchangers 20 may be more than two and water may bypass each or several of the water heat exchangers 20.

Third Embodiment

The heat exchange apparatuses 1 according to the first embodiment and the second embodiment includes a plurality of water heat exchangers 20 respectively provided with the expansion valve 45. In addition, the degree of opening each expansion valve 45 may be determined to reduce a temperature difference between the refrigerants discharged from the plurality of water heat exchangers 20.

This is because water flows through upstream water heat exchanger 20A and the downstream water heat exchanger 20B of the water heat exchanger 20 in series. Also, this is because the upstream water heat exchanger 20A and the downstream water heat exchanger 20B are plate type water heat exchangers including the same heat transfer area (the same number of heat transfer plates).

That is, in case the heat exchange apparatus 1 cools water, if the upstream water heat exchanger 20A and the downstream water heat exchanger 20B are plate type water heat exchangers having the same number of heat transfer plates as described above, the heat transfer amount of the upstream water heat exchanger 20A is different from the heat transfer amount of the downstream water heat exchanger 20B. Here, the upstream water heat exchanger 20A and the downstream water heat exchanger 20B are respectively provided with the expansion valves 45A and 45B to control the temperature of the refrigerant discharged from the refrigerant inlet/outlet 20Ab of the water heat exchanger 20A and the temperature of the refrigerant discharged from the refrigerant inlet/outlet 20Bb of the water heat exchanger 20B to be the same as or similar to each other.

However, when there is no difference (the same) or little difference between the heat transfer amount of the upstream water heat exchanger 20A and the heat transfer amount of the downstream water heat exchanger 20B, there will be no difference or little difference between the degree of opening the expansion valve 45A provided at the upstream water heat exchanger 20A and the degree of opening the expansion valve 45B provided at the downstream water heat exchanger 20B. In this case, the expansion valves 45A and 45B of the upstream water heat exchanger 20A and the downstream water heat exchanger 20B may be replaced with one valve.

Figure 5:
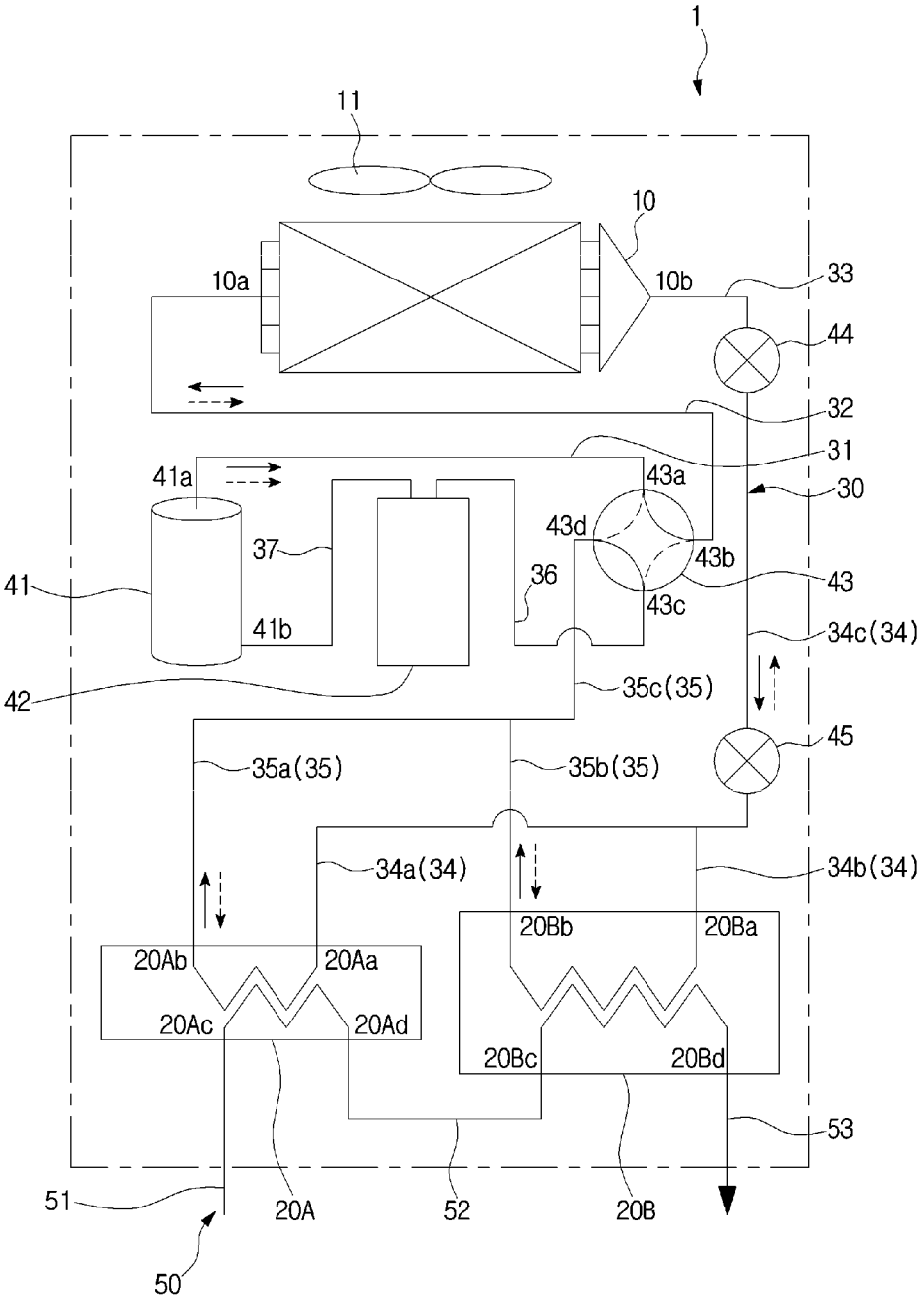
FIG. 5 is a view illustrating an example of a heat exchange apparatus according to a third embodiment.

FIG. 5 is a view illustrating an example of a heat exchange apparatus 1 according to a third embodiment.

The heat exchange apparatus 1 according to the third embodiment may be set to have no difference or little difference between a heat transfer amount of the upstream water heat exchanger 20A and the that of the downstream water heat exchanger 20B. For example, when the water heat exchangers 20A and 20B are plate type heat exchangers, the heat transfer amounts thereof are set according to the heat transfer areas (numbers of heat transfer plates), respectively. Thus, the heat transfer areas of the water heat exchangers 20A and 20B are respectively set to have no difference or little difference between the heat transfer amounts thereof. For example, a ratio of the heat transfer area of the upstream water heat exchanger 20A to the heat transfer area of the downstream water heat exchanger 20B is about 1:1.8.

In addition, the expansion valve 45 is installed to be shared by the water heat exchanger 20A and the water heat exchanger 20B.

Here, the expansion valve 45 is an example of the expansion device.

The heat exchange apparatus 1 according to the third embodiment is set to have no difference (the same) or little difference between the heat transfer amount of the upstream water heat exchanger 20A and the heat transfer amount of the downstream water heat exchanger 20B. Thus, there is no difference or little difference between the temperature of the refrigerant discharged from the refrigerant inlet/outlet 20Aa of the upstream water heat exchanger 20A and the temperature of the refrigerant discharged from the refrigerant inlet/outlet 20Ba of the downstream water heat exchanger 20B.

Thus, there is no need to install separate expansion valves (expansion valves 45A and 45B of FIGS. 1 and 4) for each of the upstream water heat exchanger 20A and the downstream water heat exchanger 20B. That is, the expansion valve 45 is shared by the water heat exchanger 20A and the water heat exchanger 20B.

However, the heat transfer amounts (heat transfer areas) of the water heat exchanger 20A and the water heat exchanger 20B may be set within a range to reduce the temperature difference between the refrigerant discharged from the refrigerant inlet/outlet 20Ab of the water heat exchanger 20A and the refrigerant discharged from the refrigerant inlet/outlet 20Bb of the water heat exchanger 20B.

Here, when the water heat exchangers 20A and 20B are plate type heat exchangers, the heat transfer amount (heat transfer area) is set as the number of heat transfer plates. Thus, the heat transfer amounts of the water heat exchangers 20A and 20B may be easily set.

Fourth Embodiment

According to the first embodiment to the third embodiment, a single heat exchange apparatus 1 is used. However, when a large amount of water should be cooled or heated, a heat exchange apparatus 1 capable of cooling and heating the large amount of water is required. In this case, a plurality of heat exchange apparatuses 1 may be arranged in parallel to correspond to the amount of water.

Figure 6:
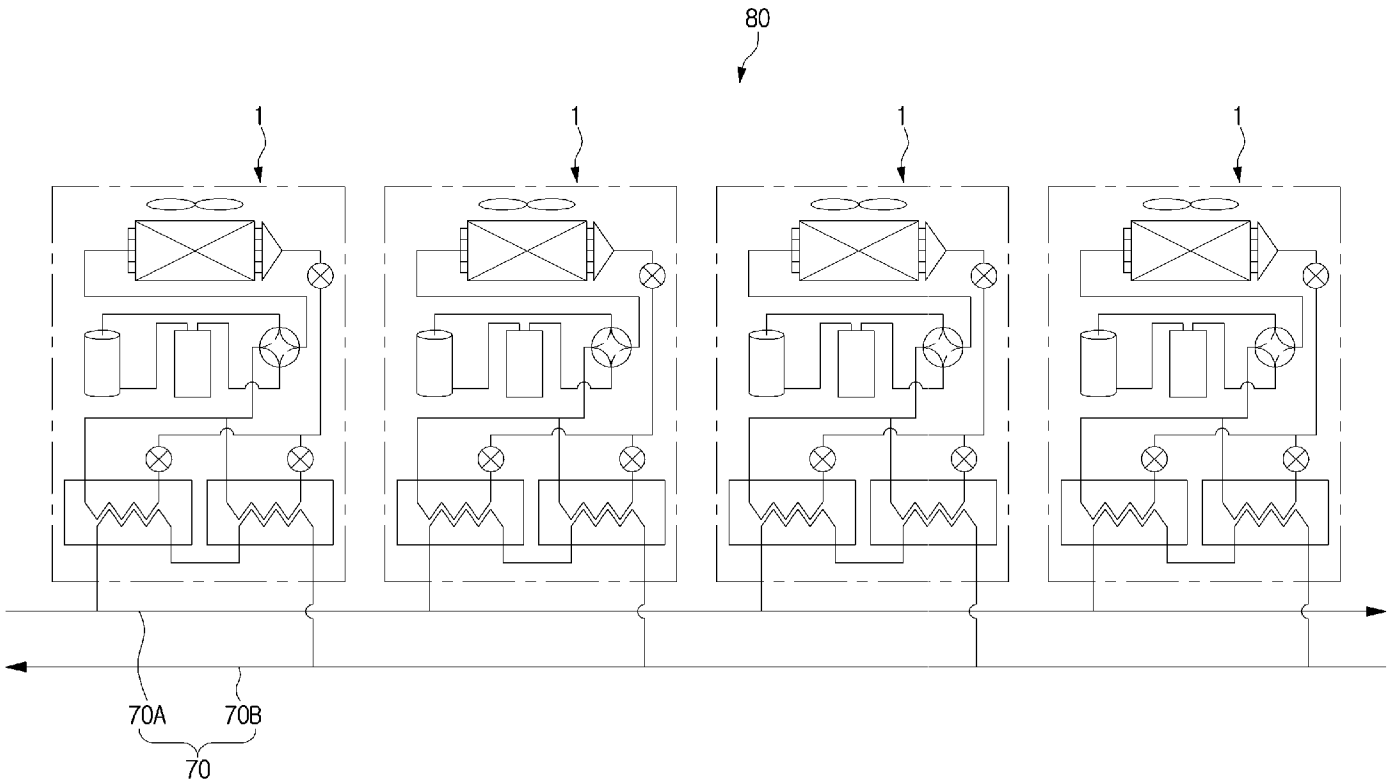
FIG. 6 is a view illustrating a heat exchange system in which a plurality of heat exchange apparatuses operate in parallel.

FIG. 6 is a view illustrating a heat exchange system 80 in which a plurality of heat exchange apparatuses 1 operate in parallel. The heat exchange system 80 of FIG. 6 includes a plurality of heat exchange apparatuses 1 according to the first embodiment (four heat exchange apparatuses 1 in FIG. 6). The heat exchange apparatuses 1 are connected in parallel between a water supply pipe 70A and a discharge tube 70B. These heat exchange apparatuses 1 operate parallel with each other.

Since operation of the heat exchange apparatus 1 is already described above with reference to the first embodiment, descriptions thereof will not be repeated.

Although the heat exchange apparatus 1 according to the first embodiment is illustrated in FIG. 6, the heat exchange apparatus 1 according to the second embodiment or the heat exchange apparatus 1 according to the third embodiment may also be used.

Fifth Embodiment

A heat exchange apparatus 1 according to a fifth embodiment includes two cases.

Figure 7:
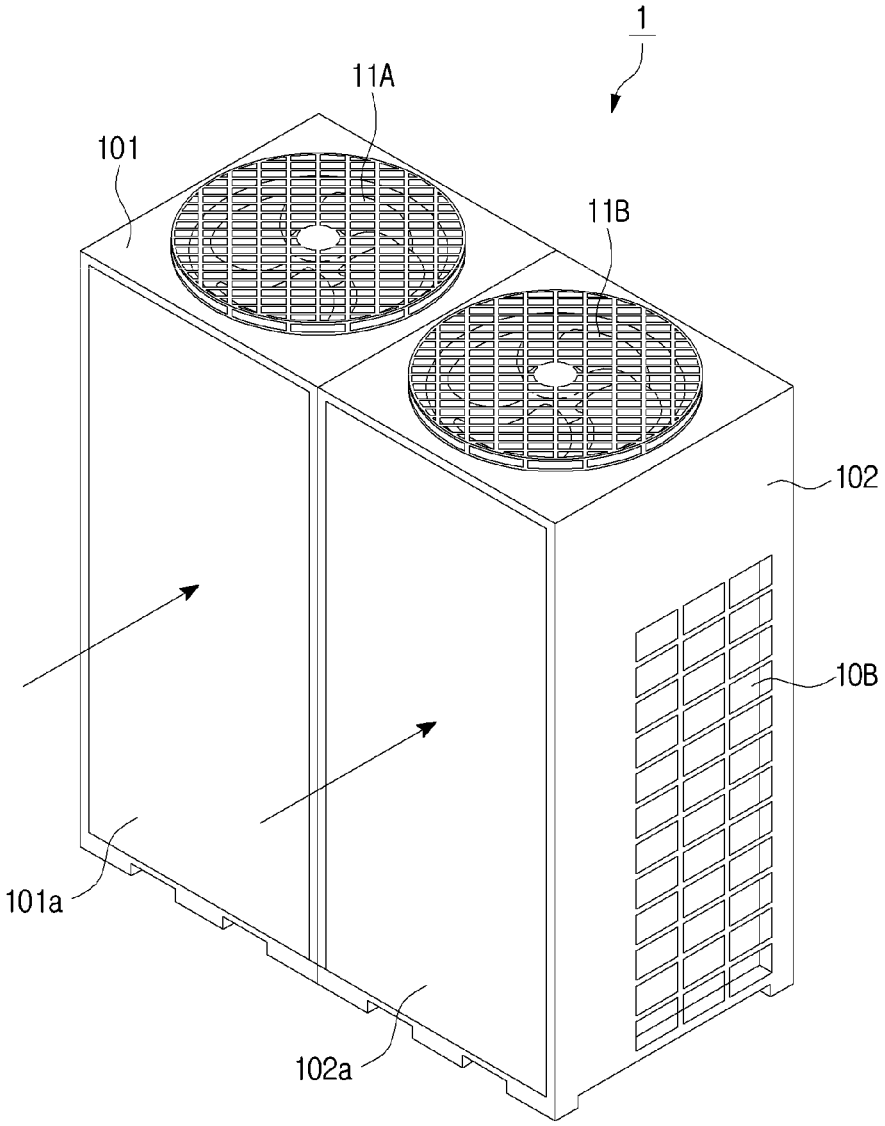
FIG. 7 is a view illustrating an appearance of the heat exchange apparatus according to the fifth embodiment.

FIG. 7 is a view illustrating an appearance of the heat exchange apparatus 1 according to the fifth embodiment. The heat exchange apparatus 1 includes two cases 101 and 102. The two cases 101 and 102 are vertically located just beside each other. The cases 101 and 102 are respectively provided with case panels 101*a* and 102*a* opened and closed for maintenance. The case panels 101*a* and 102*a* are installed at the same side surfaces of the cases 101 and 102 aligned to be adjacent to each other in the same direction. In addition, fans 11A and 11B provided in the heat exchange apparatus 1 are disposed on top surfaces of the cases 101 and 102. The air cooled heat exchanger 10B is disposed on the rear surface of the cases 101 and 102 via a lattice (grille) for ventilation. The fans 11A and 11B and the air cooled heat exchanger 10B will be described later.

Maintenance of the cases 101 and 102 may be performed by opening the case panels 101*a* and 102*a* intensively in a direction indicated by arrows.

The case 101 is an example of a first case, and the case 102 is an example of a second case.

Also, since the heat exchange apparatus 1 is divided and accommodated in two cases 101 and 102 vertically aligned to be adjacent to each other, a height thereof may be reduced. In addition, a volume may be reduced (compact size) when the heat exchange apparatus 1 is accommodated in the cases 101 and 102 compared to when the heat exchange apparatus 1 is not divided in the case 101 and the case 102. Thus, the heat exchange apparatus 1 may be easily carried and installed.

Figure 8:
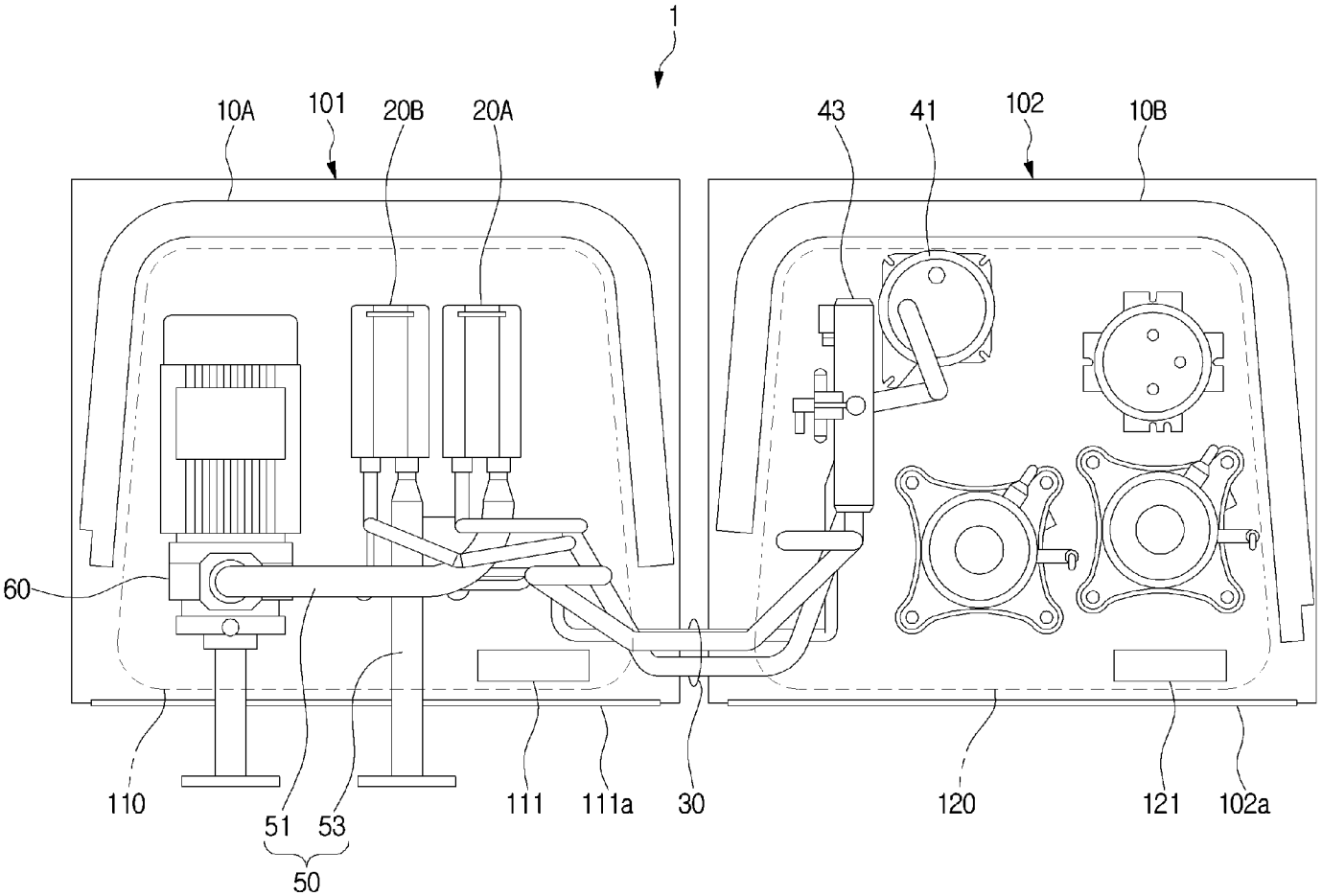
FIG. 8 is a view illustrating an example of the heat exchange apparatus according to the fifth embodiment.

FIG. 8 is a view illustrating an example of the heat exchange apparatus 1 according to the fifth embodiment. FIG. 8 is a top view of the heat exchange apparatus 1 illustrating the insides of the cases 101 and 102.

The heat exchange apparatus 1 is divided and accommodated in two cases 101 and 102. The heat exchange apparatus 1 further includes the cases 101 and 102 in addition to the heat exchange apparatus 1 according to the first embodiment.

The case 101 accommodates a portion including the water heat exchangers 20A and 20B, the pump 60, and the water pipe 50 (including the water pipes 51, 52, and 53 illustrated in FIG. 1) of the heat exchange apparatus 1, i.e., a portion where water flows (water conveying portion, hereinafter, referred to as a water circuit 110). The pump 60 is described above with reference to the heat exchange apparatus 1 according to the second embodiment illustrated in FIG. 4 and is connected to the water pipe 51 of FIG. 1.

The water circuit 110 includes a power controller 111 to control power of the water circuit 110.

However, the water pipe 50 is an example of a liquid pipe, and the water circuit 110 is an example of a liquid circuit.

Meanwhile, the case 102 accommodates a portion including the compressor 41, the accumulator 42, and the 4-way valve 43, i.e., a portion where the refrigerant flows (refrigerant conveying portion) of the heat exchange apparatus 1. However, the refrigerant is supplied to the case 101 via the refrigerant pipe 30 (e.g., the refrigerant pipes 34 and 35 illustrated in FIG. 1), which will be described later. Thus, the case 102 accommodates a portion where the refrigerant flows. Here, the portion where the refrigerant flows accommodated in the case 102 is referred to as a refrigerant circuit 120.

In addition, the refrigerant circuit 120 includes a power controller 121 to control power of the refrigerant circuit 120.

Here, the 4-way valve 43 is an example of a multi way valve.

The cases 101 and 102 include the air cooled heat exchangers 10A and 10B, respectively. The air cooled heat exchanger 10A and the air cooled heat exchanger 10B operate as the air cooled heat exchanger 10 illustrated in FIG. 1. In addition, the cases 101 and 102 are provided with the fans 11A and 11B corresponding to the air cooled heat exchangers 10A and 10B (FIG. 7). The fan 11A and the fan 11B operate as the fan 11 illustrated in FIG. 1.

The expansion valve 44 and the expansion valves 45A and 45B may be accommodated in any portion of the case 101 and the case 102.

In addition, the heat exchange apparatus 1 is connected in the cases 101 and 102 via the refrigerant pipe 30. (e.g., the refrigerant pipes 34 and 35 illustrated in FIG. 1). Thus, although the heat exchange apparatus 1 is divided into the case 101 and the case 102, assembling (installing) may not be complicated and assembling (installing) time may not be increased.

In addition, the power controller 111 to control power of the water circuit 110 is installed in the case 101, and the power controller 121 to control power of the refrigerant circuit 120 is installed in the case 102. Thus, maintenance of the water circuit 110 may be performed in the case 101. Similarly, maintenance of the refrigerant circuit 120 may be performed in the case 102. That is, there is no need to perform maintenance throughout the case 101 and the case 102. Thus, maintenance may be easily performed (maintainability is improved).

In addition, if manipulation directions of power control panels respectively installed in the power controllers 111 and 121 may be arranged toward to the case panels 101*a* and 102*a* of the cases 101 and 102, manipulation may be more efficiently performed.

In addition, connection flanges of the water circuit 110, the water pipe 50, the refrigerant circuit 120, and the refrigerant pipe 30 may be arranged close to the case panels 101*a* and 102*a* of the cases 101 and 102 to improve maintainability.

That is, as maintenance is integrated in one direction, i.e., around the case panels 101*a* and 102*a* of the cases 101 and 102, maintenance efficiency (maintainability) may be improved.

As the air cooled heat exchanger 10 that determines the size of the entire case is divided into the air cooled heat exchanger 10A and the air cooled heat exchanger 10B, the volume of the heat exchange apparatus 1 may be reduced compared to a case in which the air cooled heat exchanger 10 is installed at one portion of the case (compact size).

Figure 9:
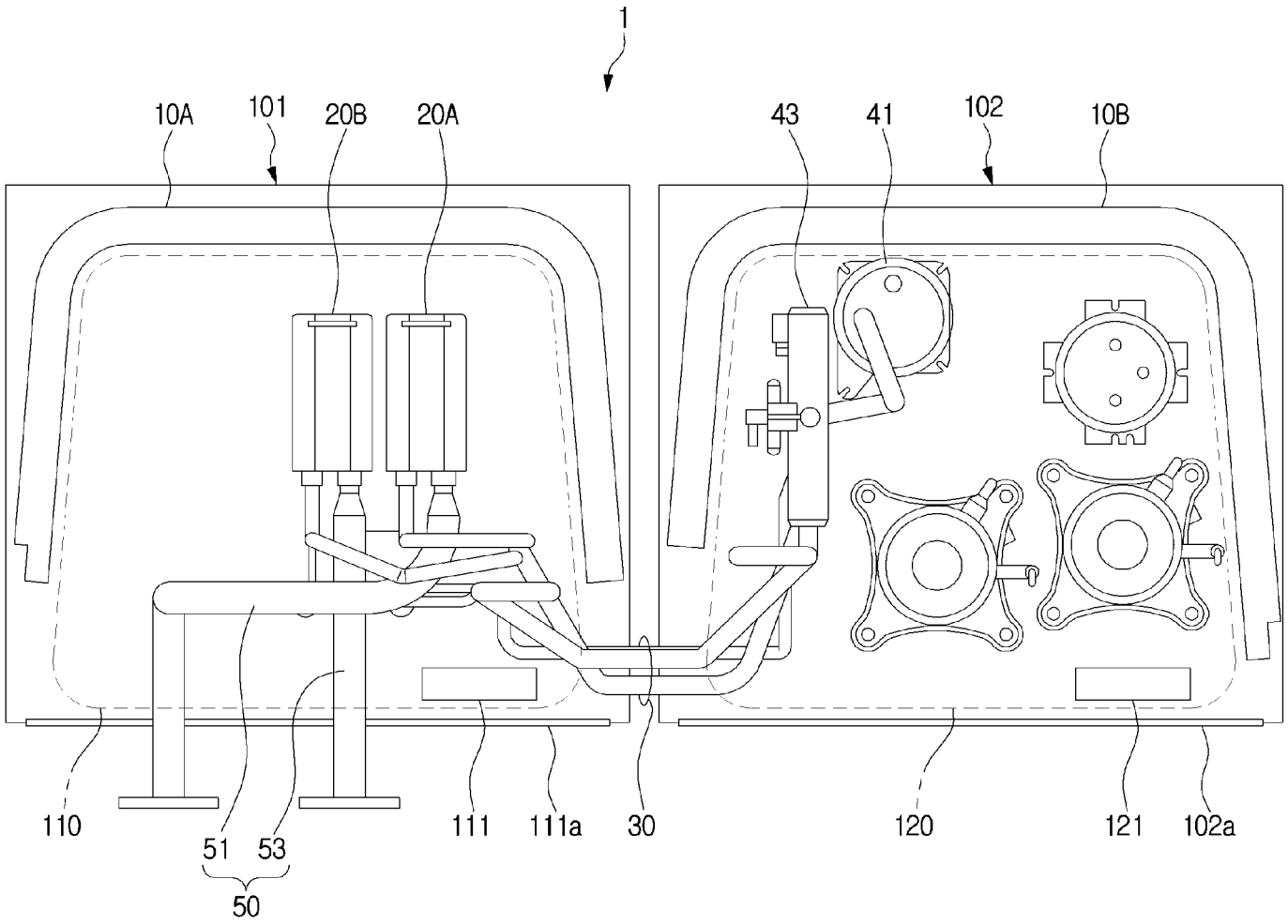
FIG. 9 is a view illustrating a modified example of the heat exchange apparatus according to the fifth embodiment.

FIG. 9 is a view illustrating a modified example of the heat exchange apparatus 1 according to the fifth embodiment. Here, the case 101 does not include the pump 60 illustrated in FIG. 8. If the pump 60 is mounted outside the heat exchange apparatus 1, the pump 60 may not be installed inside the case 101.

Here, the heat exchange apparatus 1 according to the fifth embodiment accommodated in the cases 101 and 102 is the heat exchange apparatus 1 according to first embodiment. However, the heat exchange apparatus 1 according to the second embodiment or the third embodiment may also be used therefor.

As is apparent from the above description, a heat exchange apparatus having an increased heat transfer rate of the refrigerant side and an increased heat transfer rate of the liquid side such as water.

In addition, the heat exchange apparatus may have a small size and high maintainability.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner outdoor unit comprising a heat exchange apparatus, the heat exchange apparatus comprising:

a first heat exchanger configured to transfer heat between a refrigerant and another medium;

a plurality of second heat exchangers configured to transfer heat between the refrigerant and a liquid;

a compressor connected to the plurality of second heat exchangers and configured to pressurize the refrigerant;

a multi way valve connected to the compressor and the first heat exchanger, and configured to change a direction of a flow of the refrigerant; and a plurality of expansion devices respectively connected to the plurality of second heat exchangers and configured to expand the refrigerant pressurized by the compressor, wherein the refrigerant flows through the plurality of second heat exchangers in parallel, and the liquid flows through the plurality of second heat exchangers in series, wherein respective refrigerant inlets of the plurality of second heat exchangers are directly connected to each other and/or respective refrigerant outlets of the plurality of second heat exchangers are directly connected to each other.

2. The air conditioner outdoor unit according to claim 1, wherein each of the plurality of expansion devices is connected to a respective refrigerant inlet and/or outlet of the plurality of second heat exchangers.

3. The air conditioner outdoor unit according to claim 2, wherein the liquid flowing through the plurality of second heat exchangers in series is water, and the water flows through the plurality of second heat exchangers via water pipes connected to the plurality of second heat exchangers.

4. The air conditioner outdoor unit according to claim 1, wherein each of the plurality of second heat exchangers is a plate type heat exchanger, and each of the plurality of second heat exchangers has a same or a different respective stacking number of heat transfer plates.

5. The air conditioner outdoor unit according to claim 4, wherein because the plurality of second heat exchangers are implemented as plural heat exchangers, the stacking number of the heat transfer plates of each of the plurality of second heat exchangers is less than a stacking number of heat transfer plates of a heat exchanger that is equivalent in heat transfer area to the plurality of second heat exchangers formed as a single device.

6. The air conditioner outdoor unit according to claim 5, wherein by the stacking number of the heat transfer plates of each of the plurality of second heat exchangers being less than that of the heat exchanger formed as a single device, the refrigerant is more uniformly distributed in a stacking direction of the heat transfer plates to improve a heat transfer rate of the refrigerant as compared to the heat exchanger formed as a single device.

7. The air conditioner outdoor unit according to claim 2, wherein the plurality of expansion devices are expansion valves, and the air conditioner outdoor unit controls degrees of opening of the expansion valves to minimize a temperature difference between portions of the refrigerant respectively discharged from the plurality of second heat exchangers.

8. The air conditioner outdoor unit according to claim 3, wherein the heat exchange apparatus further comprises a fluid flow bypass allowing water to bypass at least one of the plurality of second heat exchangers.

9. The air conditioner outdoor unit according to claim 8, wherein water is transferred with high pressure by a pump connected to the water pipe, and power consumption is reduced when water flows through the fluid flow bypass compared with when water flows through all of the plurality of second heat exchangers.

10. The air conditioner outdoor unit according to claim 1, further comprising two cases, wherein the heat exchange apparatus is divided between and accommodated in the two cases.

* * * * *